US005460296A

United States Patent [19]

Focke et al.

[11] Patent Number: 5,460,296

[45] Date of Patent: Oct. 24, 1995

[54] APPARATUS FOR THE STORAGE AND CONVEYANCE OF CIGARETTES OR THE LIKE

[75] Inventors: Heinz Focke, Verden; Hugo Mutschall, Kirchlinteln, both of Germany

[73] Assignee: Focke & Co (GmbH & Co.), Verden, Germany

[21] Appl. No.: 207,657

[22] Filed: Mar. 9, 1994

[30] Foreign Application Priority Data

Mar. 10, 1993 [DE] Germany ..... 43 07 552.5
Aug. 2, 1993 [DE] Germany ..... 43 25 935.9

[51] Int. Cl.[6] ..... B65H 1/00

[52] U.S. Cl. ..... 221/198; 221/156; 221/200; 221/281

[58] Field of Search ..... 221/198, 197, 221/200, 186, 281, 287, 155, 156

[56] References Cited

U.S. PATENT DOCUMENTS

| | | | |
|---|---|---|---|
| 2,560,907 | 7/1951 | Thomas et al. | 221/200 |
| 4,489,534 | 12/1984 | Gömann et al. | 221/200 X |
| 4,763,775 | 8/1988 | Jefferys et al. | 221/200 X |

FOREIGN PATENT DOCUMENTS

| | | |
|---|---|---|
| 1498450 | 9/1967 | France . |
| 2068666 | 8/1971 | France . |
| 1789968 | 1/1959 | Germany . |
| 1904495 | 11/1970 | Germany . |
| 2418562 | 11/1974 | Germany . |
| 202674 | 9/1983 | Germany . |
| 3229092 | 2/1984 | Germany . |
| 3304131 | 2/1984 | Germany . |
| 3536186 | 4/1986 | Germany . |
| 4127283 | 2/1993 | Germany . |
| 1141658 | 1/1969 | United Kingdom . |
| 2047667 | 12/1990 | United Kingdom . |

*Primary Examiner*—William E. Terrell
*Assistant Examiner*—Dean A. Reichard
*Attorney, Agent, or Firm*—Sughrue, Mion, Zinn, Macpeak & Seas

[57] ABSTRACT

For the transportation and storage of cigarettes (10), containers (11), which are open on a large-area front side and which, furthermore, have a downwardly directed emptying orifice (17), are used. This emptying orifice (17) is directed upwards before the emptying operation. In order to guarantee a regular fault-free emptying of the container (11), with the emptying orifice (17) directed downwards, there can be introduced into the container (11) pressure member (25) which extends over the entire length of a cigarette level (24) and which exerts slight pressure on the cigarettes (10). An exact horizontal cigarette level (24) is thereby established. The pressure member (25) rests on the cigarettes (10) over the entire length of the latter. To introduce the pressure member (25) into the container (11) in an upper position, the pressure member (25) s displaceable by a transversely movable actuating member, especially by a crosshead (60).

10 Claims, 4 Drawing Sheets

II
III
10
11
12
14
15
16
17
19
20
21
22
23
24
25
26
27
28
33
34
35
36
37
38
39
40
41
42
43
44
45
46
47
48
49
50
51
52
53
54
55
56
57
58
59
60
63
64
65
67
68

APPARATUS FOR THE STORAGE AND CONVEYANCE OF CIGARETTES OR THE LIKE

BACKGROUND OF THE INVENTION

The invention relates to an apparatus for the storage and conveyance of cigarettes or the like in a container (slope), from which the cigarettes can be extracted via a lower orifice, with an elongate pressure member which rests on an upper cigarette level formed during the conveyance of the cigarettes out of the container and away.

Cigarettes are often stored and transported in flat containers receiving a group of cigarettes in an equidirectional formation, but otherwise in an unordered manner. The container, also called a slope, is usually open on two sides, namely on a large-area front side and on an upper or lower long narrow side. This orifice is directed upwards during the filling of the container with cigarettes and during transport and storage. To extract the cigarettes, the container is rotated through 180°, so that the orifice is located on the underside. The cigarettes can then flow off via the open lower side.

To empty the container, the latter is conventionally placed onto a stationary collecting container assigned to a packaging machine or onto a cigarette magazine located on the machine. The cigarette stock flows off out of the container downwards according to the "consumption" of the cigarettes in the packaging machine. A cigarette level thereby forms within the container. To avoid a non-uniform formation of the cigarette level in the container, according to German Offenlegungsschrift 1,904,495 an elongate pressure member rests on the cigarette level formed during the conveyance of the cigarettes out of the container and away.

SUMMARY OF THE INVENTION

The object on which the invention is based is to propose measures for improving the above apparatus, which guarantee an ordered regular flow-off of the cigarettes out of a container.

To achieve this object, the apparatus according to the invention is defined in that the pressure member rests on the cigarette level under a bearing weight, descends together with the cigarette level as a result of the bearing weight and, in order to introduce a pressure piece of the pressure member into the container, is transversely movable relative to the container in an upper position, in particular along a rectilinear path of movement parallel to the longitudinal direction of the cigarettes.

According to the invention, the pressure piece is mounted stationarily outside the container, but, during the emptying of a container, projects at least partially into the latter via the open side face or front side. Moreover, the pressure piece rests on the cigarette level in a pressure-free manner under the bearing weight and thus brings about a plane or horizontal alignment of the cigarette level. The pressure piece is designed so that it extends, with the part exerting pressure on the cigarettes, over the entire length of the interior of the container. Pressure, which can be metered by selecting the dead weight of the pressure piece and, if appropriate, by selecting additional and counterweights, is exerted on the cigarettes, the said pressure taking effect unchanged during the entire emptying operation and therefore adjusting automatically to different emptying speeds and consequently different descending movements of the cigarette level.

The pressure piece enters the container via the open front side at least with a part, namely a pressure leg, resting on the cigarette level. Members for guiding the pressure piece and for the return movement of the latter into an upper initial position are arranged outside the region of the container laterally next to the latter.

To introduce the pressure member or a part of this into the container at the start of an emptying operation, the pressure member is transversely movable, namely along a rectilinear path of movement parallel to the longitudinal direction of the cigarettes. As a result of this movement, the pressure piece is introduced into the container in the upper region.

According to the invention, a preferably stationary cover plate is assigned to the container on the open front side. According to the invention, this cover plate is formed from lateral fixed portions and from at least one foldable middle part arranged between them. The fixed portions and foldable middle part are arranged at a distance from one another, in such a way as to produce vertical gaps, in which parts of the pressure member can move up and down.

BRIEF DESCRIPTION OF THE DRAWINGS

Further details of the invention are explained below by means of an exemplary embodiment illustrated in the drawings. In these.

FIG. I shows an apparatus for emptying a container having cigarettes.

DESCRIPTION OF THE PREFERRED EMBODIMENTS

Figure 1:
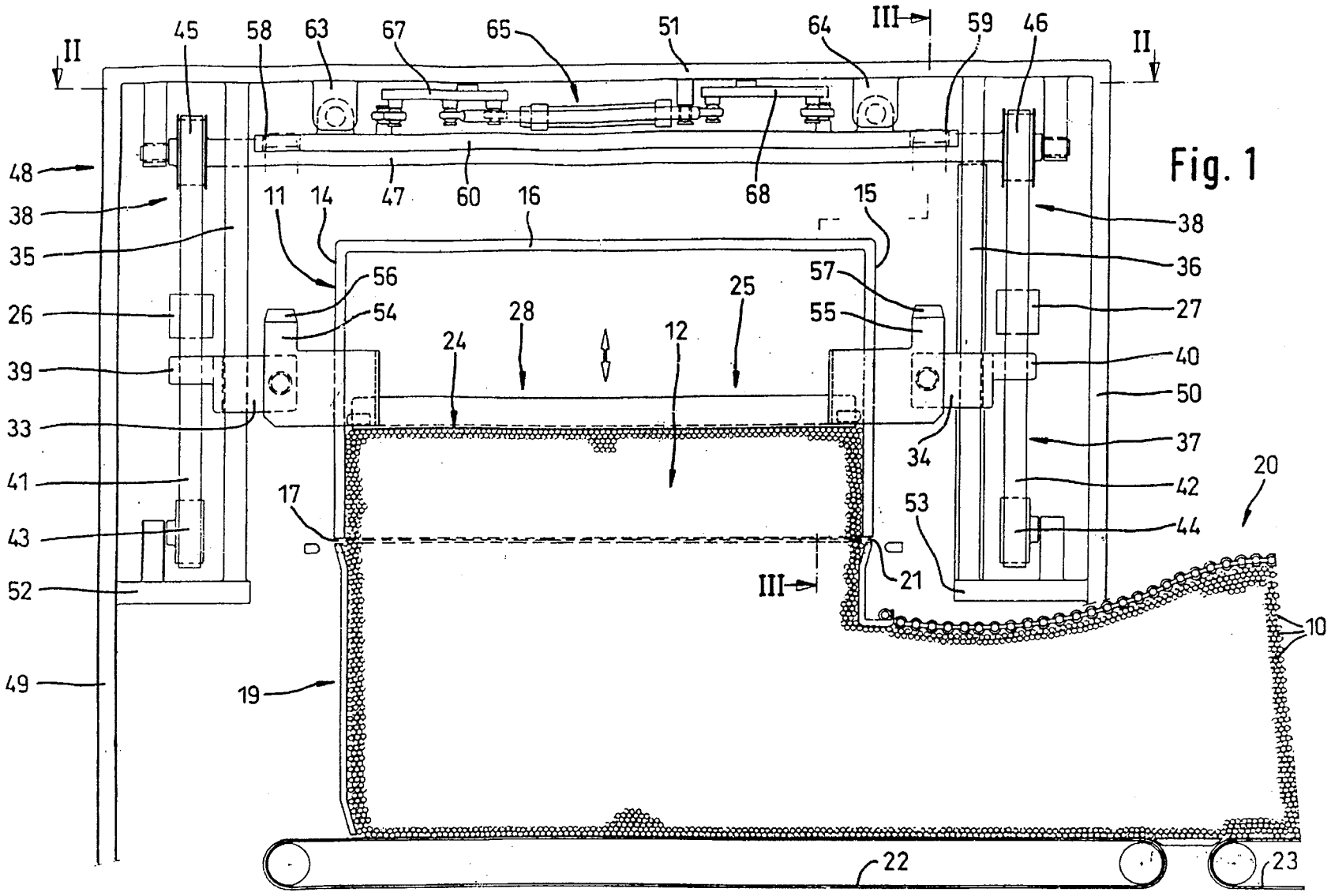

The exemplary embodiment illustrated relates to the stocking (storage), transport and further handling of conventional cigarettes 10. These come from a cigarette-producing machine and are to be supplied, if appropriate with intermediate storage, to a packaging machine. This purpose is served by special containers 11, in which a cigarette stock 12 is received temporarily. The container 11 consisting of metal or plastic consists of a (large-area) rear wall 13, narrow vertical side walls 14 and 15 and a bottom wall 16. A front side located opposite the rear wall 13 is open over the entire area. Furthermore, one elongate narrow side is open relative to the bottom wall 16. This open side serves as an emptying orifice 17 for the container 11. In the present case, the dimensions of the emptying orifice 17 correspond to the length and width of the container 11. The width of the side walls 14, 15 and of the bottom wall 16 corresponds approximately to the length of a cigarette. These are arranged aligned in parallel, but otherwise in an unordered manner, within the container 11, in such a way that ends of the cigarettes are supported, relative to a filter 18, on the rear wall 13.

For filling, transporting and storage, the container 11 is in a relative position in which the emptying orifice 17, that is to say the open side, faces upwards. For emptying, the container 11 is reversed through 180° , so that the emptying orifice 17 points downwards.

In the present exemplary embodiment, the container 11 is emptied, in the region of a packaging machine, into a collecting container 19 of a cigarette-transfer apparatus 20 located on the machine. For this purpose, the collecting container 19 is open on the top side. The dimensions (length/width) of a filling orifice 21 correspond to the dimensions of the emptying orifice 17. The collecting container 19 or the cigarette-transfer apparatus 20 is limited, on the underside, by conveyor bands 22, 23 which lead to the packaging machine or to a cigarette magazine. The cigarettes are conveyed out of the collecting container 19 and away in accordance with the processing of the cigarettes 10 in the packaging machine. Cigarettes are conveyed out of the container 11 after them correspondingly.

A cigarette level 24 forms within the container 11 in conformity with the emptying of the latter and is moved downwards gradually until the container 11 is emptied completely. The container 11 is then removed and replaced by a new filled container 11.

In order to guarantee a uniform cigarette flow during the emptying of the container 11, the cigarette level 24 forming in the container 11 is to extend approximately horizontally, at all events uniformly. For this purpose, a compensating member enters the container 11 during the emptying process. This is a pressure member 25 which rests with a bearing weight on the cigarette level 24 and which thus exerts constant pressure on the cigarette stock 12. The pressure can be fixed by determining the dead weight of the pressure member 25. To increase pressure or reduce pressure, additional weights, for example counterweights 26, 27, can be attached or removed.

The pressure member 25 consists of a pressure piece 28 which, in the present case, has a U-shaped cross-sectional profile and carrying arms 82, 83. The pressure piece 28 is designed as an open box with vertical walls **29, 29*a* and with a lower pressure leg 30 directed transversely. The pressure leg 30 is formed essentially from a central bottom wall 92 of the box and from lateral flat legs 93, 94 arranged in the extension of the bottom wall 92. The pressure piece 28 projects into the container 11 and rests on the cigarette level 24. In the present case, the pressure leg 30 is dimensioned in such a way that it rests on the cigarettes 10** over the entire length of the latter.

In a standard version of container 11 with a capacity of, for example, 6,000 cigarettes 10, an effective dead weight of the pressure member 25 of 2.5 kg is appropriate. Depending on the size or design of the container 11, the dead weight of the pressure piece is between 2 kg and 3 kg. A virtually horizontal cigarette level 24 is thereby achieved during the entire emptying operation.

The pressure member 25, especially the carrying arms 82, 83, are guided laterally, namely next to the container 11, for an up-and-down movement. For this purpose, horizontal carrying rods 31, 32 are arranged at the ends of the pressure member 25 or of the carrying arms 82, 83 and are mounted displaceably in vertical guide sleeves 33, 34. These are movable slidably on vertical guide rods 35, 36. During the downward movement of the pressure member 25 in conformity with the descending cigarette level 24, the guide sleeves 33, 34 slide downwards on the vertical guide rods 35, 36.

After the lower position is reached, the pressure member 25 is moved back into an upper initial position (FIG. 3), specifically by means of a lifting member 37 which, in the present case, is arranged laterally of the apparatus next to the guide rods 35, 36. The lifting member 37 consists, here, of toothed-belt drives 38 which are arranged on both sides of the pressure member 25 and which act on the lateral ends of the guide sleeves 33, 34.

For the upward movement of the pressure member 25, a projection 39, 40 is formed laterally on the guide sleeves 33, 34. The projections 39, 40 engage into toothed belts 41, 42 of the toothed-belt drive 38. The toothed belts 41, 42 are guided by means of lower deflecting rollers 43, 44 and upper deflecting rollers 45, 46. A counterweight 26, 27 is attached releasably, if appropriate on the outside, to a free strand of the toothed belt 41, 42. By means of the counterweights 26, 27, the pressure with which the pressure member 25 rests on the cigarettes 10 can be determined. So that synchronism is ensured, that is to say the pressure member 25 remains aligned horizontally during the movement, the toothed belts 41, 42 of the two sides are coupled to one another in transmission terms via an upper compensating shaft 47 directly transversely.

The pressure member 25 is mounted by means of actuating members on a stationary carrying structure connected to a machine stand or the like, namely on a carrying frame 48. This consists of vertical supports 49, 50 and of an upper crossmember 51. The guide rods 35, 36 are connected to one another at the upper ends by means of the crossmember 51. The lower ends or end regions of the guide rods 35, 36 are connected firmly to the supports 49, 50 of the carrying frame 48. In view of the distance of the guide rods 35, 36 from the supports 49, 50, the lower ends of the guide rods 35, 36 are connected to the supports 49, 50 via carrying arms 52, 53. The lifting member 37 is supported on the associated carrying arms 52, 53 by means of the lower deflecting rollers 43, 44.

Figure 3:
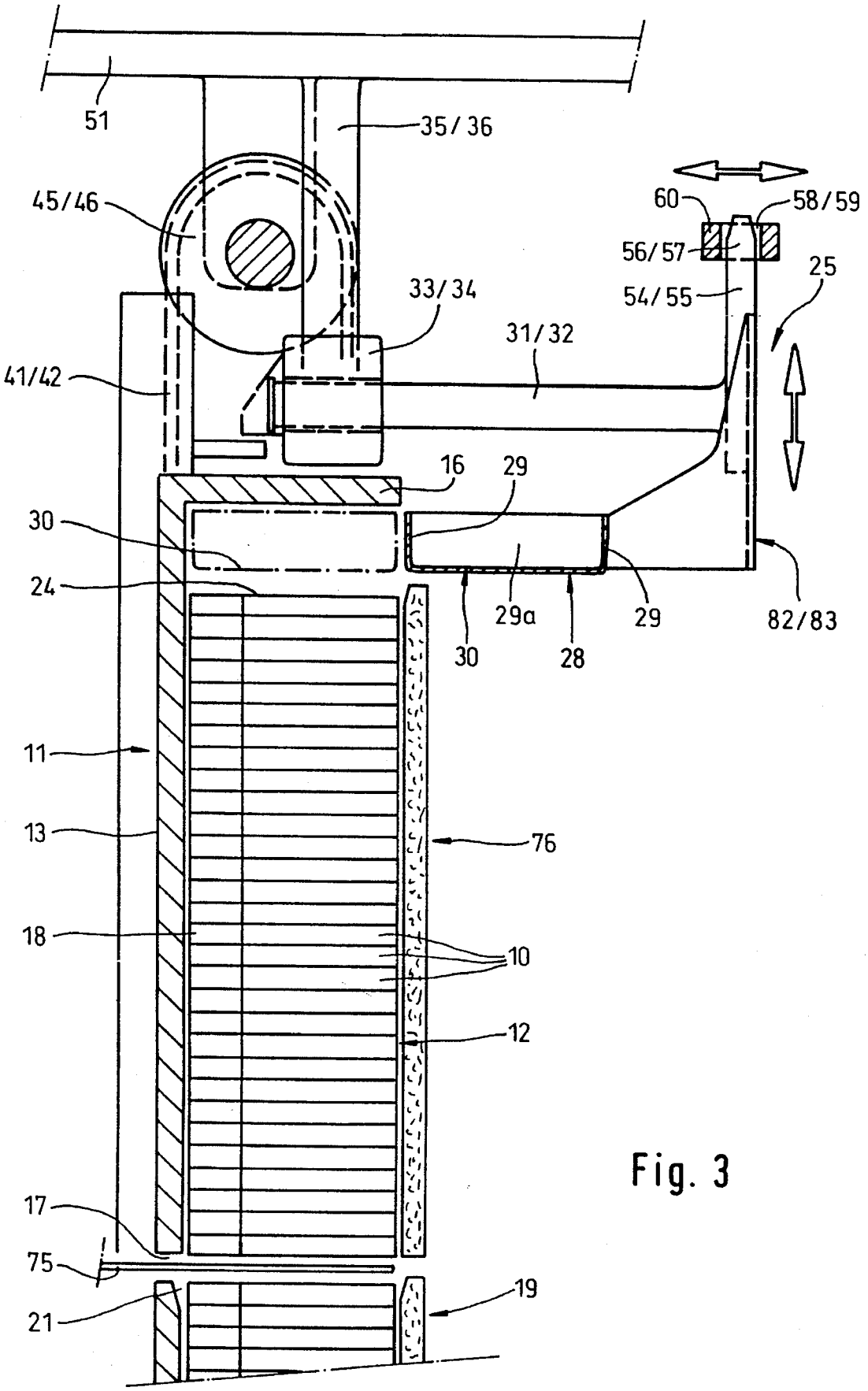
FIG. 3 shows an (upper) part of the apparatus according to FIG. 1 in a side view and in vertical section on an enlarged scale.
Figure 4:
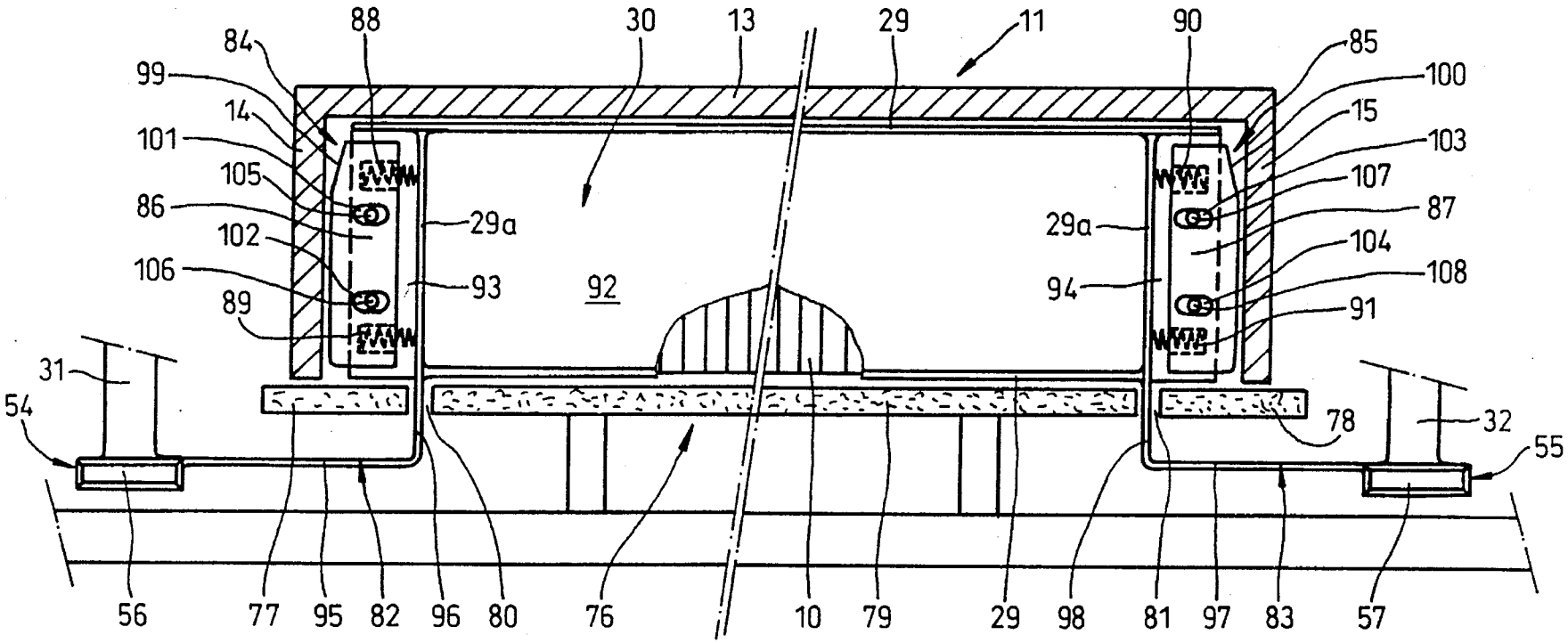
FIG. 4 shows the (upper) part of the apparatus according to FIG. 3 in a top view and in horizontal section.
Figure 2:
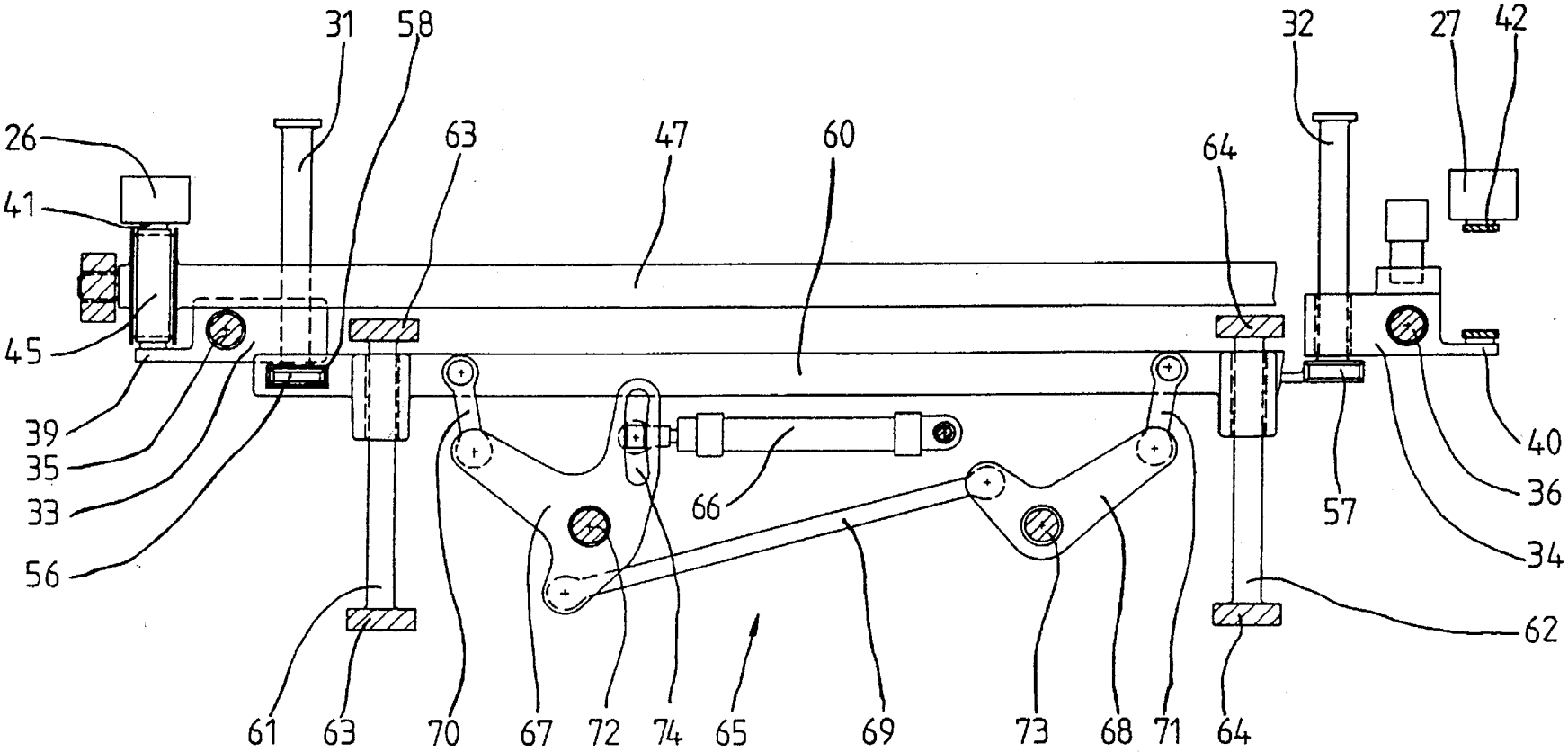
FIG. 2 shows an (upper) part of the apparatus according to FIG. 1 in a top view and in horizontal section on an enlarged scale.

For introduction into the (filled) container 11, the pressure member 25 is transversely movable in the upper position (FIG. 3). For this purpose, the pressure member 25 is provided with a coupling piece 54, 55 at each of the lateral ends. In the upper end position, the coupling pieces 54, 55 enter via tenons 56, 57 recesses 58, 59 of a transversely movable actuating member. This is a crosshead 60. In its upper position, the crosshead 60 is then moved transversely. At the same time, the pressure piece 28 enters an upper free space of the container 11, that is to say above the cigarette level 24. The emptying operation can now commence.

The crosshead 60 is mounted movably on guide rods 61, 62. For this purpose, brackets 63, 64 for fastening the guide rods 61, 62 are attached to the crossmember 51 of the carrying frame 48. The crosshead 60 is mounted so as to be transversely displaceable on the horizontally directed guide rods 61, 62. The to-and-fro movement of the crosshead 60 is generated by a mechanical drive 65 which is mounted on the underside of the crossmember 51. This drive comprises a cylinder 66, two pivoting levers 67, 68 and coupling members 69, 70 and 71. These members bring about an exactly parallel-directed displacement of the crosshead 60 by means of only one actuating means (cylinder 66). The pivoting levers 67, 68 are connected to one another by means of the coupling member 69 and are each mounted rotatably on a stationary bearing 72, 73. Each pivoting lever 67, 68 is connected to the crosshead 60 by means of a further coupling member 70, 71. The adjusting movement of the cylinder 66 can therefore be transmitted to the crosshead 60 which can thereby be displaced in a manner directed exactly parallel. The piston rod of the cylinder 66 is mounted adjustably in a slotted link 74 of the pivoting lever 64. By means of adjustments, the stroke, that is to say the amplitude of movement, of the crosshead 60 can be set.

In the emptying position with the emptying orifice 17 pointing downwards, the filled containers 11 are first closed off by means of a closing wall 75 which is arranged in the plane above the filling orifice 21 of the collecting container 19. In this closing position, the closing wall 75 extends between the set-down container 11 and the collecting container 19. In order to initiate the emptying operation for the container 11, a closing wall 75 is retracted out of its closing position. The emptying orifice 17 and filling orifice 21 are then opened.

Provided on the free side of the container 11 in the emptying position is a stationary cover. This consists of a vertical cover wall 76, preferably made of transparent material (acrylic glass). The cover wall 76 is divided. It consists of two lateral fixed portions 77, 78 and of a foldable middle part 79 arranged between the portions 77, 78. The portions 77, 78 and the middle part 79 are arranged at a distance from one another, so that gaps 80, 81 are obtained between these. The carrying arms 82, 83 of the pressure member 25 are movable up and down in the gaps 80, 81. Each gap 80, 81 has a width of approximately 4 mm. The distance between the cover wall 76 and the cigarettes 10 is so small that an axial displacement of the cigarettes 10 is prevented.

The carrying arms 82, 83 have an angled shape, consequently each having two legs 95, 96 and 97, 98. The legs 96, 98 continue the walls **29*a* of the pressure piece 28 as extensions. The legs 95, 97 angled relative to the legs 96, 98 are assigned to the coupling pieces 54, 55. Compensating members 84, 85 are arranged laterally on the walls 29*a* of the pressure piece 28 in the region of the flat legs 93, 94 of the pressure leg 30. The compensating members 84, 85 are displaceable spring-loadable plates 86, 87 which are each mounted on the walls 29*a* via two springs 88, 89 and 90, 91. Even if the containers 11 are not of the correct shape, the compensating members 84, 85 always ensure a smooth closing off of the pressure piece 25 on the side walls 14, 15 of the container 11. In the state located outside the container 11, the pressure piece 28, as a result of non-loaded compensating members 84, 85 has a greater width than an interior of the container 11 receiving the cigarettes 10. So that the pressure piece 28 of the pressure member 25 can be introduced into the container 11 in a simple way, the compensating members 84, 85 have slopes 99, 100. To avoid tilts of the compensating members 84, 85 during the introduction of the pressure piece 28 into the container 11, the compensating members 84, 85 are each provided with two guide grooves 101, 102 and 103, 104, into which guide bolts 105, 106 and 107, 108 of the flat legs 93 and 94** engage.

What is claimed is:

1. An apparatus for the storage and conveyance of elongated cigarettes (10) or the like in a container (11) from which the cigarettes (10) can be extracted via a lower emptying orifice (17), said apparatus comprising an elongate pressure member (25) which rests on an upper cigarette level (24) formed during the conveyance of the cigarettes (10) out of the container (11) and away; wherein the pressure member (25) rests on the cigarette level (24) under a bearing weight, descends together with the cigarette level (24) as a result of the bearing weight, and, in order to introduce a pressure piece (28) of the pressure member (25) into the container (11), is transversely movable relative to the container (11) in an upper position, along a rectilinear path of movement parallel to the longitudinal direction of the elongated cigarettes (10): and wherein the pressure piece (28) rests, with a pressure leg (30) thereof directed transversely, on the cigarettes (10).

2. The apparatus as claimed in claim 1, wherein the pressure piece (28) has a U profile in cross section, with vertical walls (**29, 29*a*), with the transversely directed pressure leg (30), and with compensating members (84, 85) which are assigned to the walls (29*a*) and which are mounted on the walls (29*a*) via springs (88, 89, 90, 91) and have slopes (99, 100) for the introduction of the pressure piece (28) into the container (11**).

3. An apparatus for the storage and conveyance of elongated cigarettes (10) or the like in a container (11) from which the cigarettes (10) can be extracted via a lower emptying orifice (17), said apparatus comprising an elongate pressure member (25) which rests on an upper cigarette level (24) formed during the conveyance of the cigarettes (10) out of the container (11) and away; wherein the pressure member (25) rests on the cigarette level (24) under a bearing weight, descends together with the cigarette level (24) as a result of the bearing weight, and, in order to introduce a pressure piece (28) of the pressure member (25) into the container (11), is transversely movable relative to the container (11) in an upper position, along a rectilinear path of movement parallel to the longitudinal direction of the elongated cigarettes (10); and wherein the pressure piece (28) is mounted outside the container (11) freely movable on vertical guide rods (35, 36).

4. The apparatus as claimed in claim 3, wherein a mounting for the guide rods for the pressure piece (28) (35, 36) is mounted on a stationary carrying frame (48) with vertical supports (49, 50) and with an upper crossmember (51).

5. An apparatus for the storage and conveyance of elongated cigarettes (10) or the like in a container (11) from which the cigarettes (10) can be extracted via a lower emptying orifice (17), said apparatus comprising an elongate pressure member (25) which rests on an upper cigarette level (24) formed during the conveyance of the cigarettes (10) out of the container (11) and away; wherein the pressure member (25) rests on the cigarette level (24) under a bearing weight, descends together with the cigarette level (24) as a result of the bearing weight, and, in order to introduce a pressure piece (28) of the pressure member (25) into the container (11), is transversely movable relative to the container (11) in an upper position, along a rectilinear path of movement parallel to the longitudinal direction of the elongated cigarettes (10); and wherein the pressure piece (28) is movable to and fro along a horizontal guide, via a crosshead (60) along guide rods (61, 62) thereof, for entry into and exit from the container (11).

6. The apparatus as claimed in claim 5, wherein the crosshead (60) is mounted displaceably on a crossmember (51), and wherein a mechanical drive (65) acts on said crosshead (60).

7. An apparatus for the storage and conveyance of elongated cigarettes (10) or the like in a container (11) from which the cigarettes (10) can be extracted via a lower emptying orifice (17), said apparatus comprising an elongate pressure member (25) which rests on an upper cigarette level (24) formed during the conveyance of the cigarettes (10) out of the container (11) and away; wherein the pressure member (25) rests on the cigarette level (24) under a bearing weight, descends together with the cigarette level (24) as a result of the bearing weight, and, in order to introduce a pressure piece (28) of the pressure member (25) into the container (11), is transversely movable relative to the container (11) in an upper position, along a rectilinear path of movement parallel to the longitudinal direction of the elongated cigarettes (10); and wherein the container (11) is covered on an open side by a stationary cover wall (76), wherein the cover wall (76) consists of lateral fixed portions (77, 78) and of at least one foldable middle part (79) arranged between said fixed portions, and wherein the fixed portions (77, 78) of the cover wall (76) are arranged at a distance from the middle part (79), in such a way that vertical gaps (80, 81) for the passage of the pressure member (25) are formed between the fixed portions (77, 78) and the middle part (79).

8. An apparatus for the storage and conveyance of elongated cigarettes (10) or the like in a container (11) from which the cigarettes (10) can be extracted via a lower emptying orifice (17), said apparatus comprising an elongate pressure member (25) which rests on an upper cigarette level (24) formed during the conveyance of the cigarettes (10) out of the container (11) and away; wherein the pressure member (25) rests on the cigarette level (24) under a bearing weight, descends together with the cigarette level (24) as a result of the bearing weight, and, in order to introduce a pressure piece (28) of the pressure member (25) into the container (11), is transversely movable relative to the container (11) in an upper position, along a rectilinear path of movement parallel to the longitudinal direction of the elongated cigarettes (10); and wherein the pressure member (25) is assigned a compensating shaft (47) in order to achieve synchronism during up-and-down movement of said pressure member (25), and wherein the pressure member (25) is indirectly or directly connected on edge regions thereof to a lifting member (37) having toothed-belt drives (38) which are arranged on two opposing sides of the pressure member (25) and which are connected to one another by means of the compensating shaft (47).

9. An apparatus for the storage and conveyance of elongated cigarettes (10) or the like in a container (11) from which the cigarettes (10) can be extracted via a lower emptying orifice (17), said apparatus comprising an elongate pressure member (25) which rests on an upper cigarette level (24) formed during the conveyance of the cigarettes (10) out of the container (11) and away; wherein the pressure member (25) rests on the cigarette level (24) under a bearing weight, descends together with the cigarette level (24) as a result of the bearing weight, and, in order to introduce a pressure piece (28) of the pressure member (25) into the container (11), is transversely movable relative to the container (11 ) in an upper position, along a rectilinear path of movement parallel to the longitudinal direction of the elongated cigarettes (10); and wherein the pressure piece (28) has a U profile in cross section, with vertical walls (**29, 29*a*), with a transversely directed pressure leg (30), and with compensating members (84, 85) which are assigned to the walls (29*a*) and which are mounted on the walls (29*a*) via springs (88, 89, 90, 91) and have slopes (99, 100) for the introduction of the pressure piece (28) into the container (11**).

10. The apparatus as claimed in claim 1, 3, 7, 8, 9, wherein the bearing weight of the pressure member (25) on the cigarette level (24) can be adjusted by means of the dead weight of the pressure member (25), and by means of additional weights or counterweights (26, 27).

* * * * *